US005090467A

United States Patent [19]

Smuckler

[11] Patent Number: 5,090,467

[45] Date of Patent: Feb. 25, 1992

[54] VERTICAL BLIND TRACK PROTECTOR

[76] Inventor: Lawrence I. Smuckler, 1301-A Comanche Ave., Point Pleasant, N.J. 08742

[21] Appl. No.: 705,578

[22] Filed: May 24, 1991

[51] Int. Cl.[5] ..... E06B 9/26

[52] U.S. Cl. ..... 160/176.1; 160/178.1; 160/900

[58] Field of Search ..... 160/176.1, 168.1, 178.1, 160/172, 166.1, 173, 177, 900

[56] References Cited

U.S. PATENT DOCUMENTS 4,122,884 10/1978 Salzmann ..... 160/176.1 X
4,261,408 4/1981 Debs ..... 160/176.1
4,262,728 4/1981 Debs ..... 160/168.1
4,293,021 10/1981 Arena ..... 160/176.1 X
4,332,288 6/1982 Frentzel et al. ..... 160/168.1 X
4,736,784 4/1988 Boloix ..... 160/168.1
4,834,163 5/1989 Dickstein ..... 160/176.1

*Primary Examiner*—David M. Purol
*Attorney, Agent, or Firm*—Charles I. Brodsky

[57] ABSTRACT

The vertical blind track protector of the invention operates to prevent the vanes of the blind from traversing in the closed position. The track protector is inserted on the pinion rod between the end control of the blind and the nearest carrier, and is fabricated with holes on either side to accept the traverse cords. Pulling the control chain to rotate the pinion gear to close the vanes then correspondingly rotates the track protector, twisting the traverse cords. Pulling the operating cord to later traverse the blind actuates the track protector to automatically rotate the pinion rod and the vanes back to an "open" position before the traversing begins.

5 Claims, 3 Drawing Sheets

VERTICAL BLIND TRACK PROTECTOR

The present invention is the subject of a disclosure document filed with the Patent Office on Jan. 28, 1991, as Ser. No. 272,249.

FIELD OF THE INVENTION

This invention relates to the installation of vertical-blinds and, more particularly, to a vertical blind track modification which is both inexpensive to manufacture and install, yet provides significant improvements in overall operation.

BACKGROUND OF THE INVENTION

As is well known and understood, those who install and service vertical blinds appreciate that most complaints and requests for repairs that they receive relate to broken tracks or track components. As is also well known and understood by those in the art, those complaints and repair requests that relate to stripped or broken carriers and end controls usually result from a person traversing the blind while its vanes (or "louvers") are in a "closed" position. Although customers are advised by the installer how the vanes are to be in an "open" position before the blind is to be traversed, such information oftentimes is not communicated to other members of the family, or to guests who may thereafter seek to traverse the blind when the vanes are "closed".

Whether the vane be constructed of fabric, aluminum, polyvinylchloride, etc.—and whether the blind be a 1-way draw or as a center-opening arrangement drawing to either side of a window frame—the typical end result of traversing the blind with the vanes closed frequently results in a need to replace its end control, or a carrier, or a new vane—and it is not unusual to have to replace the entire track, itself, as when many carriers are damaged. Even though the possibility of this resultant damage is well recognized, presently available track installations continue to allow the very real chance of damage to continue. This will be understood to be particularly true where the installation is at a hotel, a motel, or at a commercial place of business where it is difficult, or even impossible, to instruct all possible users as to the correct way to traverse the blind to begin with.

One philosophy in addressing this problem with be seen to be one which prevents the vertical blind from operating at all if anyone attempts to traverse the blind with the vanes in their closed position. Then, pulling on the traverse cord would effectuate no control. One limitation of that, however, is that the user might continue to pull and jerk the traverse cord thinking that it was stuck, and cause further damage and breakage. A preferred approach, however, will be seen as one which automatically operates to place the vanes into their correct open position, automatically, when a user desires to traverse the blind—that is, a construction philosophy which automatically opens the vane prior to its traverse beginning.

SUMMARY OF THE INVENTION

As will become clear from the description that follows, the vertical blind track protector of the invention operates to prevent the vanes of the blind from traversing in the closed position. Designed to operate with the metal or plastic scissors spacing system tracks commonly employed in the industry, the track protector is inserted on the pinion rod between the end control of the blind and the nearest carrier. When employed with 2" and 3½"–4" vanes, and of a basic design of the type illustrated in U.S. Pat. No. 4,834,163, for example, the track protector will be seen to be fabricated with a pair of spaced apertures, or holes, on either side in accepting the traverse cords employed. Pulling the control chain to rotate the pinion so as to close the vanes then will be seen to correspondingly rotate the track protector, twisting the traverse cords along the rod in so doing. Pulling the operating cords to later traverse the blind then untwists the cords along the pinion rod, in actuating the track protector to automatically rotate the rod and the vanes back to the "open" position before any traversing begins. Although particularly described in connection with a fluted pinion rod of common 8-prong design, it will be appreciated that the teachings of the invention to be described below will operate equally as well with any type of pinion rod, as long as the track protector of the invention is sufficiently fixedly secured to the pinion rod so as to turn with it, and so that its turning, in turn rotates the fluted rod.

BRIEF DESCRIPTION OF THE DRAWINGS

These and other features of the present invention will be more clearly understood from a consideration of the following description, taken, in connection with the accompanying drawings, in which.

DETAILED DESCRIPTION OF THE DRAWINGS

Figure 1:
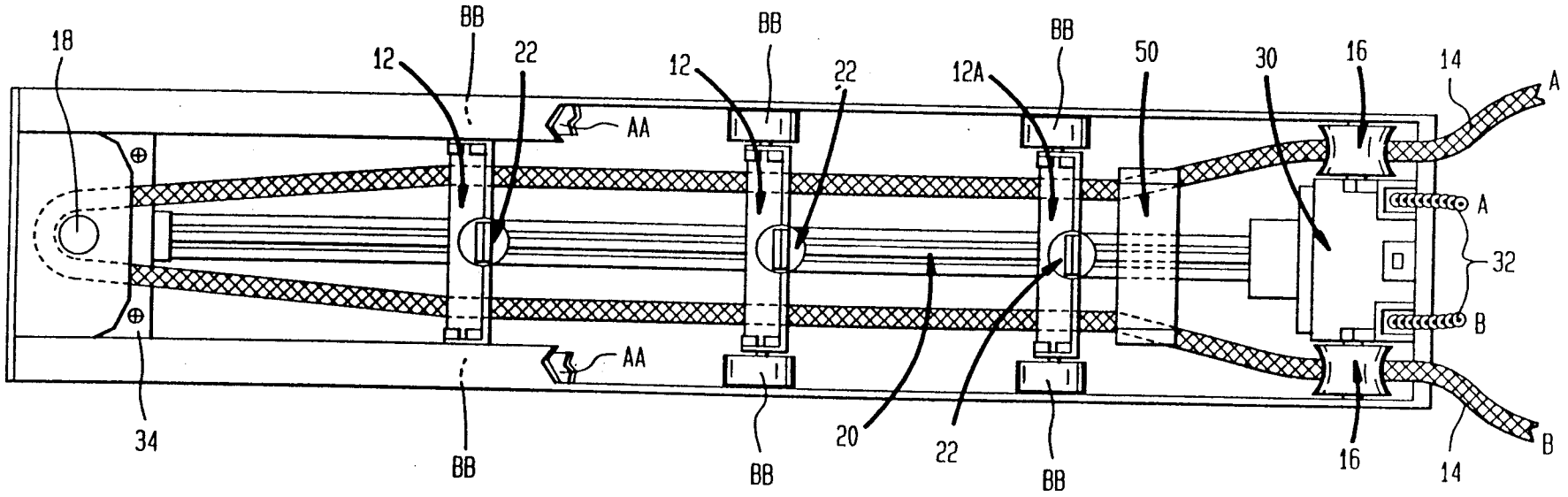
FIG. 1 is an illustration of the underside of an 8-prong vertical blind track constructed in accordance with a preferred embodiment of the invention.

Referring to FIG. 1, the vertical-blind track 10 is shown in partial break-away form at AA to show three of a plurality of carriers 12 which fit within the track 10, as at BB, and which are able to slide back-and-forth within the track—i.e. traverse the track under control of a traverse cord or cords 14 which pass under the rollers 16, through the carriers 12, and around a further roller 18. As typically manufactured by Scientific Plastics Inc., by B & D Precision Tools, Inc., or by Eastern Metal Supply, Inc. or Graber Industries Inc.—and as described in U.S. Pat. No. 4,834,163—, the track also incorporates a fluted pinion rod 20, preferably of an 8-prong construction. In accordance with these designs, a plurality of friction clips 22 are coupled with the carriers 12 to connect with the vanes, or louvers (not shown) of the vertical blind, with the clip 22 having at its opposite end a toothed gear to ride atop the individual flutes of the rod 20.

Also shown in FIG. 1 is an end control 30 and a control chain 32. As is well known and understood, a pull of the control chain 32 actuates a gearing in the end control 30 so as to rotate the pinion rod 20 to which it is secured, and with such rotation of the rod 20 being translated by the tooth gearing of the friction clip 22, in turn rotating the clip 22 to either "open" or "close" the vanes carried in the clip. As will be apparent, a second end connector 34 is shown, to receive the opposite end of the pinion rod 20, in a manner so as to allow rotation either clockwise, or counterclockwise of the pinion rod 20 under control of the chain 32, in either opening or closing the vanes.

With the rollers 16 as shown, the apparatus of FIG. 1 as so far described will be appreciated to be that which is available in the prior art as constituting vertical-blind track installations. Pulling on one end A of the control chain 32 rotates the pinion rod 20, the clips 22 and the vanes carried thereon in one direction, while pulling on the end B of the chain 32 rotates the pinion rod 20, the clips 22 and the vanes carried in an opposite direction. Pulling on the section A of traverse cord 14 moves the carriers 12, the clips 22 and the vanes carried thereby closer to the end control 30, while pulling on the section B of the traverse cord 14 moves the carriers 12, the clips 22 and the vanes closer to the connector 34. Pulling on section A of the cord 14 thus draws the vertical-blind open, while pulling on the section B of the cord 14 draws the vertical-blind closed. As will be apparent, in this prior art construction, the actions of the operating cord 14 and chain 32 are independent, and their respective functions performed independently of one another. And, as will be understood by those skilled in the art, it is just such independent action which allows for the carriers 12 to be moved along the length of the pinion rod 20 whether the vanes be opened, or closed, giving rise to the damage which oftentimes results in trying to traverse the blind while the vanes are in their "closed" position. (As will be appreciated, the orientation of the clips 22 shown in FIG. 1 represents the situation where the vanes would be in an "open" position.)

As previously mentioned, however, the apparatus of the present invention differs from the prior art designs by the inclusion of the track protector of the invention, generally illustrated by the reference numeral 50. The respective front, back, top and side views of the protector 50 are illustrated in FIGS. 2, 3, 5 and 6, with FIG. 4 showing a top sectional view of the protector. As will be seen in FIGS. 2–4, the track protector 50 includes an internal configuration 52 to accept the pinion rod 20 which is arranged to pass through it., and with that configuration being comprised of individual sections to accept each prong of the rod 20 and to be held fixedly secured with it. Thus, with the 8-prong rod 20 of FIG. 1, the track protector 50 is shown with eight individual sections 55 to receive the individual prongs, or flutes, of the rod 20. In such manner, as the rod 20 is made to rotate either in one direction or the other, by pulling on the ends A or B of the operating cord 32, the track protector 50 is caused to rotate in similar manner.

Figure 2:
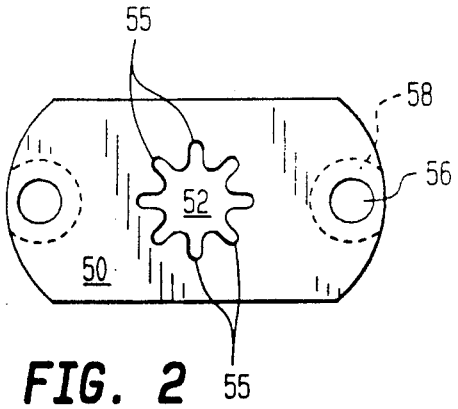
FIG. 2 is a front view of the track protector of the invention, as seen from the nearest carrier of the blind to which it faces.
Figure 3:
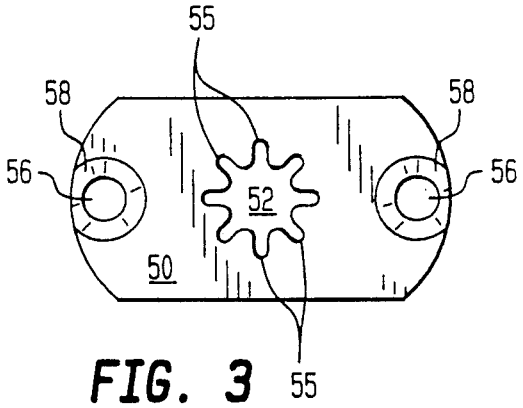
FIG. 3 is a back view of the track protector as seen from end control of the track.
Figure 4:
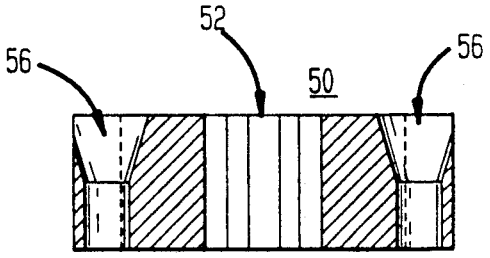
FIG. 4 is a top sectional view of the protector of FIGS. 2 and 3.
Figure 5:
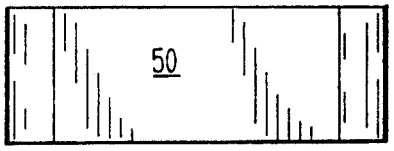
FIGS. 5 and 6 are top and side views, respectively, of the track protector of the invention.
Figure 6:
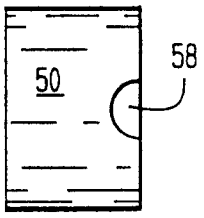

As will also be seen in FIGS. 2–4, the track protector 50 further incorporates a pair of spaced apertures, or holes, 56 through which the traverse cord 14 also passes in extending through, and coupling to, the individual carriers 12 in operating to move the carriers in a direction to draw the vanes one way or the other in opening and/or shutting the blind. Located between the end control 30 and the carrier 12A which is the one nearest to the end control 30, the track protector 50 is fabricated with spaced apertures 56 being outwardly flared, as at 58, to facilitate the ease with which the traverse cord 14 is oriented to pass the apertures 56, and with a reduced amount of friction as the traverse cord 14 passes the edges of the apertures 56.

In understanding the operation of the present invention, it is to be first noted that the illustration of FIG. 1 represents the positioning of the track protector 50 and the traverse cord 14 for a condition where the clips 22 on the carriers 12 orient the vanes, or louvers, in an open position. Pulling on either section A or section B of the traverse cord 14 then simply moves the carriers and the open vanes along the length of the pinion rod in drawing the blind open or shut. (This, according to the prior art, is the desired orientation to be made of the vanes when traversing the blind so as to prevent damage to its component parts.)

Figure 7:
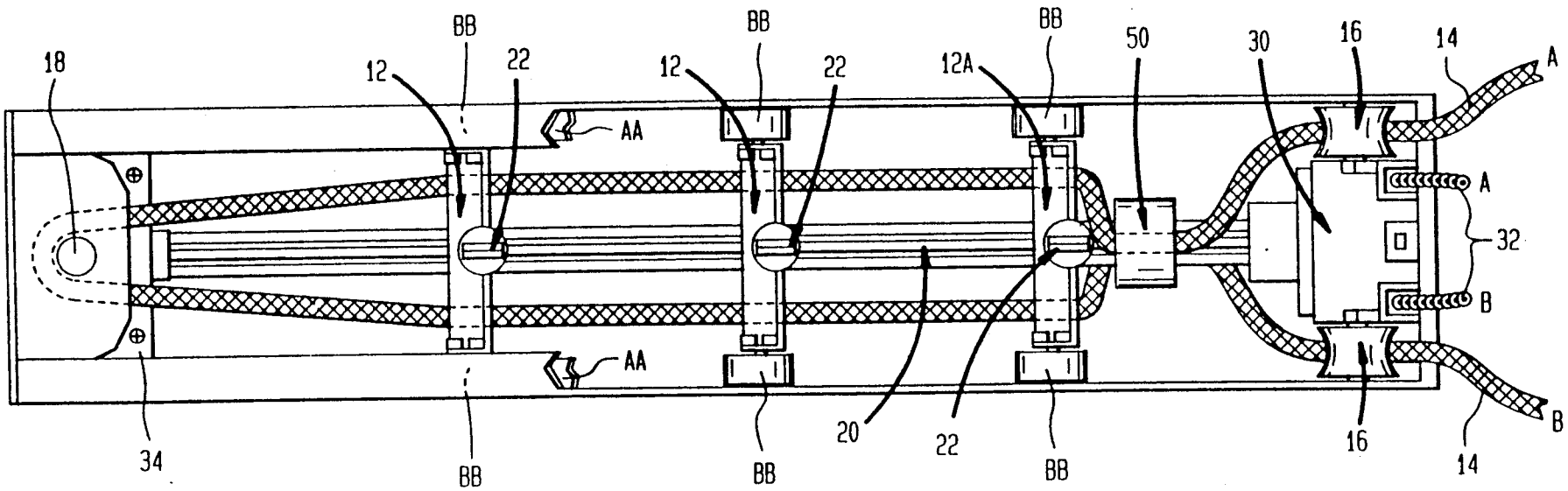
FIG. 7 is a modified version of FIG. 1, helpful in an understanding of the invention.

FIG. 7, however, illustrates the vertical blind track after a user pulls the chain 32 to close the vanes. The clips 22 will be seen to have rotated 90°—so that the vanes are now closed —, but in so doing, the track protector 50, which rides along the fluted rod 20 by virtue of its internal configuration 52, rotates a similar amount, as well, thereby twisting the traverse cord 14 as shown. Damage to the track and its components are prevented, however, as any pulling of the traverse cord 14—in a direction to either open or shut the blind—first effectuates an un-twisting of the track protector 50 by means of the cord passing the apertures 56; and, by virtue of the coupling between the protector 50 and the rod 20 first, and automatically, rotates the pinion rod 20 and, by means of the toothed gearing of the clip 22, rotates the clip to its original, or open, position as shown in FIG. 1. Thus, any grasping of the traverse cord 14 in a manner so as to open a drawn vertical blind having its vanes closed automatically rotates the vanes to their opened position, and then continues to traverse the blind open. Analysis will show the same operation to follow if a user were intending, instead, to traverse the blind shut with the vanes closed, i.e., the pulling of the traverse cord to effectuate that first operates to rotate the vanes open before the traverse action begins.

As will be appreciated by those skilled in the art, the end result is that cord movement is not obstructed, and smooth traversing occurs. When the control chain 32 rotates the pinion rod 20 to louver the vanes closed, the track protector 50 rotates with the pinion rod 20 twisting the traverse cords in so doing. If traverse is attempted in this "VANE CLOSED" position, the spring action of the twisted cords in attempting to return to the straight, position configuration places a torsional force on the pinion rod, with the result that the pinion rod automatically rotates back to the "VANE OPEN" position before the unit traverses. As will be apparent, the pinion rod 20 will rotate to open even if the "wrong" or non-operating traverse section of the cord is pulled, and even if both traverse cords are pulled simultaneously.

While there have been described what are considered to be preferred embodiments of the present invention, it will be appreciated by those skilled in the art that modifications can be made without departing from the scope of the teachings herein. Thus, whereas the present invention has been described in the context of an 8-prong pinion rod, the teachings will be seen to apply equally as well to any particular shaped fluted rod, as long as the internal configuration of the track protector is able to accept that configuration in fixed securement, and to rotate along with it. Similarly, whereas the traverse, or operating, cord 14 is illustrated in FIGS. 1 and 7 as being a single, continuous cord, all that is required is that the cord 14, when pulled in one direction actuates all the carriers 12 one way, and when pulled in the opposite direction actuates all the carriers 12 the other way —whatever the particular arrangement actually decided upon might eventually be. For at least such reasons, therefore, resort should be had to the claims appended hereto for a true understanding of the scope of the invention.

I claim:

1. In a vertical-blind track, apparatus comprising:

a fluted pinion rod;

a plurality of carriers coupled to said pinion rod along its length;

a plurality of vanes held by said carriers;

an end control on one end of said rod;

track protector means, incorporating a pair of spaced apertures, positioned on said pinion rod between said end control and the one of said plurality of carriers nearest said end control;

a pull chain cooperating with said end control to rotate said rod;

a traverse cord passing through each of said spaced apertures on said track protector means and through said carriers to selectively position said plurality of vanes along the length of said pinion rod;

and with said track protector means having an internal configuration to accept the flutes of said pinion rod in fixed securement with said rod, and to correspondingly rotate along with said rod under control of pull-chain actuation, to allow any pulling of said chain to rotate said rod in closing said plurality of vanes to rotate said track protector means to twist said traverse cord passing therethrough, and to allow any subsequent pulling of said traverse cord in positioning said plurality of vanes to untwist said traverse cord to automatically rotate said rod to open said plurality of vanes before any positioning of said vanes occurs.

2. The apparatus of claim 1 wherein said pinion rod comprises an 8-prong fluted rod.

3. The apparatus of claim 2 wherein said track protector means has an internal configuration of eight individual sections to accept each prong of said fluted rod in fixed securement.

4. The apparatus of claim 1 wherein said spaced apertures of said track protector means are symmetrically positioned with respect to said internal configuration thereof.

5. The apparatus of claim 4 wherein said spaced apertures are outwardly flared.

* * * * *